US006939498B2

(12) United States Patent
Wong

(10) Patent No.: US 6,939,498 B2
(45) Date of Patent: Sep. 6, 2005

(54) METHOD OF MAKING CRYSTALLIZED BOTTLENECKS

(75) Inventor: Chio Fai Wong, ZhuHai (CN)

(73) Assignee: Zhuhai Zhong Fu PET Beer Bottle Co., Ltd. (CN)

( * ) Notice: Subject to any disclaimer, the term of this patent is extended or adjusted under 35 U.S.C. 154(b) by 87 days.

(21) Appl. No.: 10/051,362

(22) Filed: Jan. 22, 2002

(65) Prior Publication Data

US 2002/0160136 A1 Oct. 31, 2002

(30) Foreign Application Priority Data

Jan. 22, 2001 (CN) ..... 01107496 A
Dec. 4, 2001 (CN) ..... 01139569 A

(51) Int. Cl.[7] ..... B32B 1/08

(52) U.S. Cl. ..... 264/239; 428/35.7; 428/36.9; 428/542.8

(58) Field of Search ..... 264/239, 230; 428/35.7, 36.9, 542.8, 36.92

(56) References Cited

U.S. PATENT DOCUMENTS 4,591,060 A * 5/1986 Tsukada et al. ..... 215/42
4,933,135 A * 6/1990 Horwege et al. ..... 264/521
6,012,597 A * 1/2000 Nishihara et al. ..... 215/398
6,659,298 B2 * 12/2003 Wong ..... 215/373

* cited by examiner

*Primary Examiner*—Sandra Nolan Rayford

(74) *Attorney, Agent, or Firm*—Venable; James R. Burdett; Daniel G. Vivarelli, Jr.

(57) ABSTRACT

A method for making a crystallized bottleneck of a polyester beer bottle is provided. The bottleneck has no machined screw threads and a length of 0.5–35 mm. To manufacture the crystallized bottleneck, an uncrystallized blank of the bottle is placed in an air-condition environment and a crystallizer is preheated before crystallization. A bunker is loaded with the uncrystallized blank, which is delivered to a blank horse's head via a conveyor belt. A bottleneck portion of uncrystallized bottle blank is then sent into a crystallizer to heat it at high temperature and crystallize it via an arbor transmission chain. The polyester bottle blank having a crystallized bottleneck portion is discharged through output blank horse's head and delivered to another conveyor belt to cool and shape it.

9 Claims, 3 Drawing Sheets

METHOD OF MAKING CRYSTALLIZED BOTTLENECKS

BACKGROUND OF THE INVENTION

1. Field of the Invention

The invention relates to a container for receiving liquid, more specifically, to a crystallized bottleneck of a polyester beer bottle and a manufacturing method for the same.

2. Description of the Related Art

Currently, beer bottles are mostly made of glass, and have a flanged top in the bottleneck for covering and sealing the bottle with a cap. However, due to the fragility of the glass bottle, which can be dangerous for the user if the bottle breaks, is plastic is preferred for bottling beer. As is well known, a bottle for holding effervescent beverages, such as beer,requires an excellent pressure-tightness. For example, Chinese Patent application CN971981515.5 discloses a zero oxygen seepage plastic bottle for beer and other use. This is a laminated plastic vessel having improved oxygen seepage resistance. It has a layer containing an oxygen scavenger. Both the structure and manufacturing process of this plastic beer bottle are complicated. A specially assigned oligomer chain segment formulation is required, preventing the fabrication cost from being lowered.

It is also well known that the pressure-tightness of a beer bottleneck is a key point to determining the pressure-tightness of the whole vessel. However the disclosed content in the above-mentioned patent application does not describe how to improve effectively the structure and pressure-tightness of a beer bottleneck made of a plastic material, and does not relate to whether any deformation would occur, along with a loss in pressure-tightness, in the bottleneck portion after sterilization processing at high temperatures, such as 70° C. (Pasteurization). In fact, the pressure-tightness for the bottleneck of a plastic beer is a key problem to be solved, because the pressure-tightness directly affects the quality of the bottled beer.

SUMMARY OF THE INVENTION

An object of the invention is to provide a crystallized bottleneck of a polyester beer bottle, which exhibits an excellent pressure-tightness and can hold an initial shape for the polyester beer bottle after sterilization processing at high temperature.

Another object of the invention is to provide a method for manufacturing a crystallized bottleneck of a polyester beer bottle to keep an excellent pressure-tightness after sterilization at high temperatures.

To realize above objects of the invention, the first aspect of the invention provides a crystallized bottleneck of a polyester beer bottle, which has a crystallized length of 0.5–35 mm through shaping a bottle blank at high temperature. The crystallized bottleneck has no machined screw thread.

Preferably, the crystallized bottleneck of the polyester beer bottle has a flange at the top of the bottleneck, and there is a transitional curved surface between the flange and a top plane of the bottleneck.

Preferably, a flanged ring is provided to the crystallized bottleneck of the polyester beer bottle. The flanged ring has a plane bottom surface at a proper position spacing from the top flange of the bottleneck. An upper surface of the flanged ring is an acclivitous plane. The acclivitous plane forms an angle of 45° from the vertical direction and converges to the outer surface of the bottleneck portion. The second aspect of the invention provides a manufacturing method for a crystallized bottleneck of polyester beer bottle comprising the steps of forming a blank of a bottle made of polyester material through drying; ejecting the polyester material and shaping it through cooling: placing the uncrystallized blank of the bottle for 24–72 hours in an air-conditioned environment; preheating a crystallizer for two hours or more prior to crystallization of the blank of the bottle; loading a bunker with the uncrystallized blank; delivering the uncrystallized blank to an blank horse's head via a conveyor belt; sending a bottleneck portion of uncrystallized bottle blank into a crystallizer to heat it at high temperature and crystallize it via an arbor transmission chain; at the same time, controlling the temperature of the uncrystallized portion of the blank body, so it is not affected by the environment at high temperature; discharging the polyester bottle blank having a crystallized bottleneck portion through an output blank horse's head; and delivering the discharged polyester bottle blank to another conveyor belt to cool and shape it.

Preferably, a cooling partition is used to prevent the uncrystallized portion of the bottle body from being affected by the high temperature environment of the crystallizer.

For a person skilled in the relevant field of technology, it is easily understood that a polyester beer bottle having a crystallized bottleneck portion would be obtained after the polyester bottle blank having a crystallized bottleneck is made with above-mentioned method and is placed for 24 hours in an air-conditioned environment, then further blown and shaped by heating and by means of blow molding machines.

The crystallized bottleneck of the polyester beer bottle and the manufacturing method for the same provided by the invention effectively enhance the heat-durability of the bottleneck of the polyester beer bottle and stability for maintaining its dimension, so that the polyester beer bottle exhibits to an excellent pressure-tightness effect, and it is reliable for ensuring the quality of the beer received therein.

BRIEF DESCRIPTION OF THE DRAWINGS

Through the detailed description for the embodiments incorporated with the attached drawings, the structure, features and advantages of the crystallized bottleneck of the polyester beer bottle of the invention will become more clear, and the manufacturing method of the crystallized bottleneck of the polyester beer bottle will be further described, in which.

DETAILED DESCRIPTION OF PREFERRED EMBODIMENTS

Figure 1:
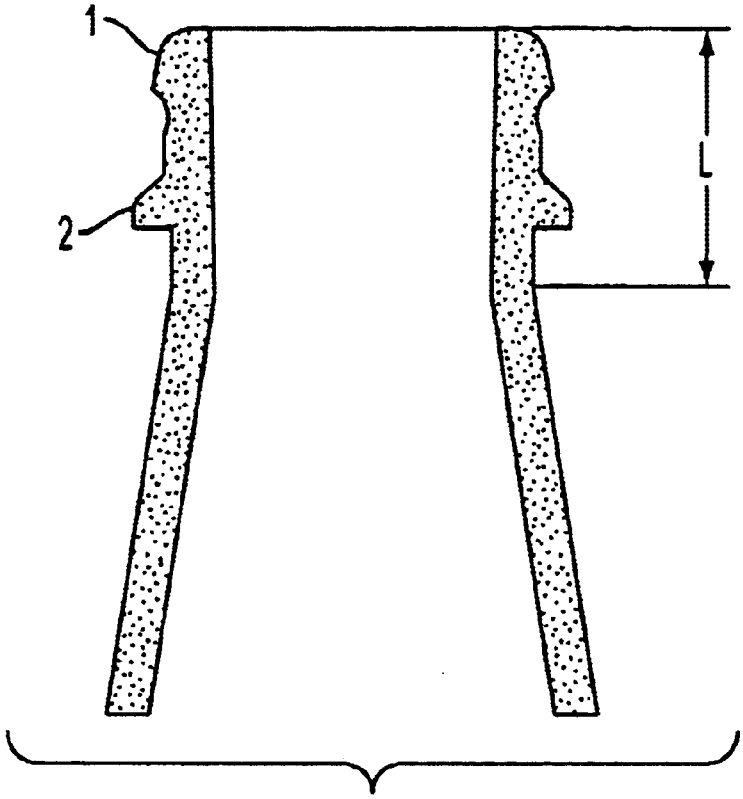
FIG. 1 is a cross section view showing the crystallized bottleneck of a polyester beer bottle in an embodiment of the invention.
Figure 2:
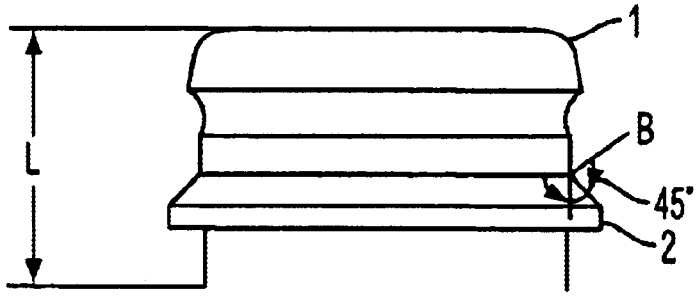
FIG. 2 shows schematically the crystallized bottleneck of a polyester beer bottle in another embodiment of the invention.
Figure 3:
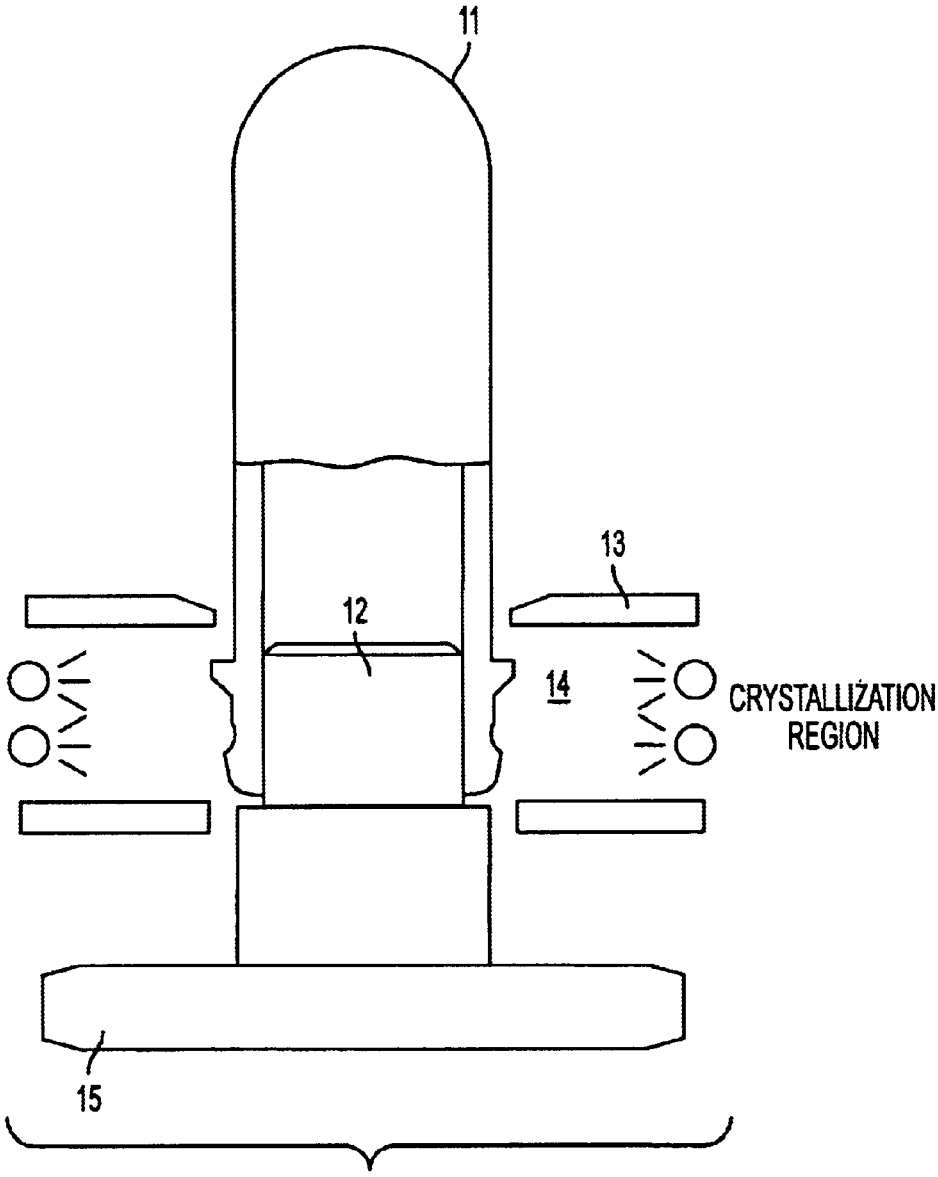
FIG. 3 is a schematic partially showing an arrangement of the device for crystallizing a bottleneck of a polyester beer bottle.

Referring to FIGS. 1–3, the crystallized bottleneck of the polyester beer bottle of the invention is produced by heating and shaping the bottleneck portion at high temperature after an uncrystallized blank is delivered to the crystallizer. The resulting crystallized bottleneck has no machined screw thread. The crystallized bottleneck has a length L of 0.5–35 mm, preferably 0.5–10 mm.

In a preferred embodiment, an exemplary crystallized bottleneck of a polyester beer bottle is produced with polyethylene terephthalate (PET) material.

FIG. 1 is a cross section view showing the crystallized bottleneck of a polyester beer bottle in an embodiment of the invention. In this embodiment, the crystallized bottleneck of polyester beer bottle is provided with a flanged ring 2 having a plane bottom surface at a proper position spacing from the top flange 1 of the bottleneck.

FIG. 2 shows schematically a crystallized bottleneck of a polyester beer bottle in another embodiment of the invention. In this embodiment, the crystallized bottleneck of the polyester beer bottle is provided with a flanged ring 2 having a plane bottom surface at a proper position spacing from the top flange 1 of the bottleneck. An upper surface of the flanged ring 2 is an acclivitous plane. The acclivitous plane forms an angle of 45° from the vertical direction and converges to the outer surface of the bottleneck portion, as shown by a marker B in FIG. 2.

Figure 4:
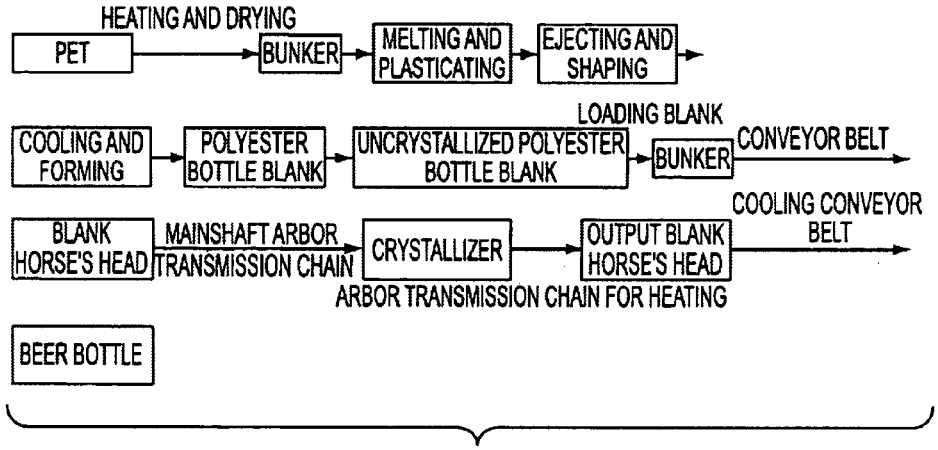
FIG. 4 is a process flow diagram of an embodiment of the method of manufacturing a crystallized bottleneck of a polyester beer bottle in the invention.

In an exemplary embodiment, a technological process for producing a crystallized bottleneck of a polyester beer bottle will be described in detail, with reference to FIG. 3 and FIG. 4. In this embodiment, PET material is used.

Preparation

To ensure a sufficient crystallization, it is necessary that the uncrystallized blank of the bottle is placed for 24–72 hours in an air-conditioned environment before the bottle blank is crystallized, after which a crystallization process can be started.

It is also necessary that a crystallizer be preheated for two hours or more before the crystallization for the blank of the bottle is started, so the temperature of the arbors and other parts in the crystallizer become uniform (see FIG. 3). Preheating the crystallizer ensures a uniform crystallization for the bottleneck portion of PET bottle blank.

In FIG. 3, in this embodiment, the bottleneck portion of a PET bottle blank 11 obtained by the above processes is inserted into the arbor 12 of the sprocket wheel 15. At the same time, the crystallized region of the bottleneck is insulated by a cooling partition 13 so that the uncrystallized portion of the body is not affected by an environment at high temperature.

During the manufacturing process, the various components in the crystallizer should be kept clean, to prevent dust absorption in the bottle blank due to static electrification during the crystallization.

Technological Process

After the uncrystallized blank is loaded into a bunker, the bunker is delivered to a blank horse's head via a conveyor belt, then a bottleneck portion of the uncrystallized bottle blank is sent into a crystallizer to heat it at high temperature and crystallize it via an arbor transmission chain.

The polyester bottle blank having a crystallized bottleneck portion is discharged through an output blank horse's head and delivered to another conveyor belt to cool and shape the bottle blank. Finally, a beer bottle blank having a crystallized bottleneck is obtained.

For a person skilled in the relevant field of technology, it is easily understood, after such bottle blank having a crystallized bottleneck is placed for 24 hours in an air-conditioned environment, then further blown and shaped, when heated up, by means of blow molding machines, that a PET beer bottle having a crystallized bottleneck would be obtained.

Technological Conditions

Before a bunker is loaded with the uncrystallized blank, the temperature of bottle blank is controlled by an arbor temperature controller and the temperature of the bottle blank typically is controlled in a range of 120–150° C. After the uncrystallized bottleneck portion of the bottle blank is fed into the crystallizer, the temperature of the bottle blank is controlled by a bottleneck temperature controller, and the temperature of the bottle blank typically is controlled in a range of 130–170° C. In crystallization, the crystallization temperature should be adjusted according to the operation speed of the crystallizer. Generally, the faster the operation speed of the crystallizer, the higher the required crystallization temperature. For example, when the operation speed for crystallizing the portion of the bottle blank is in a range of 7,500–10,000 blanks per hour, i.e. the crystallization time required for each bottle blank is in a range of 90–120 seconds, the corresponding crystallization temperature is in a range of 130–170° C.

While the bottle blank is crystallized in the crystallizer, in order to prevent an influence from the high temperature of the crystallization on the bottle blank, the body portion of bottle blank is placed under indirect cooling, where the cooling to partition is cooled with cooling water and the temperature of cooling water is controlled in a range of 15–18° C. At the same time, the uncrystallized body portion of bottle blank is always outside of the crystallizer.

Analysis of Molecular Structure

Figure 5:
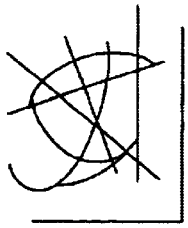
FIG. 5 is a schematic of molecular structure of polyethylene terephthalate (PET) material before it is crystallized.
Figure 6:
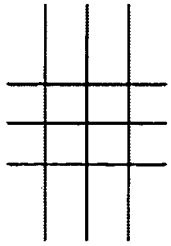
FIG. 6 is a schematic of molecular structure of PET material when the crystallization is started.
Figure 7:
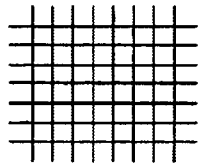
FIG. 7 is a schematic of molecular structure of PET material after the PET material is crystallized at high temperature.

Before and after crystallizing the bottleneck portion of a PET beer bottle, the arrangement for the molecular structure of PET material would exhibit obvious differences. The original molecular structure of PET material is an amorphous state in disorder under normal temperature, as showed in FIG. 5. After a crystallization is implemented at high temperature, the molecular structure becomes regular and ordered, as showed in FIGS. 6 and 7.

Comparison of the Performance Before and After Crystallization

The performance of a PET bottleneck would exhibit obvious differences before and after crystallization. A comparison result is in the table 1:

TABLE 1

| PET bottle blank before crystallization | PET bottle blank after crystallization |
|---|---|
| a transparent state | Non transparent |
| (normal non-transparent) | Ivory white |
| Vitrification point: 67° C. | vitrification point: 81° C. |
| Density: 1.33 g/cm$^3$ | density: 1.455 g/cm$^3$ |
| Relatively poor mechanical behavior | excellent mechanical behavior |
| Preferable extension at break | the higher crystallinity, the better the thermal stability harder hardness |

What is claimed is:

1. A method for manufacturing a crystallized bottleneck of a polyester beer bottle, comprising the steps of:

forming a blank of a bottle made of polyester material through drying;

ejecting the polyester material and shaping said ejected polyester material through cooling, thereby forming an uncrystallized blank of a bottle;

placing the uncrystallized blank of the bottle for 24–72 hours in an air-conditioned environment;

preheating a crystallizer for at least two hours prior to crystallizing the blank of the bottle;

loading a bunker with the uncrystallized blank of the bottle;

delivering to an blank horse's head via a conveyor belt;

sending a bottleneck portion of the uncrystallized bottle blank into said crystallizer to heat the bottleneck portion at a high temperature and crystallize the bottleneck portion via an arbor transmission chain;

at the same time, controlling the temperature of the uncrystallized portion of the blank body, so that the uncrystallized portion of the blank body is not affected by the high temperature environment of the crystallizer;

discharging the polyester bottle blank through an output blank horse's head;

and delivering to another conveyor belt to cool and shape the polyester bottle blank.

2. A method according to claim 1, wherein before said bunker is loaded with the uncrystallized blank, the temperature of the bottle blank is controlled by an arbor temperature controller; and, after the uncrystallized bottleneck portion of the bottle blank is fed into the crystallizer, the temperature of the bottle blank is controlled by a bottleneck temperature controller.

3. A method according to claim 2, wherein when said bunker is loaded with the uncrystallized blank, the temperature of the bottle blank is controlled in a range of 120–150° C.

4. A method according to claim 2, wherein the uncrystallized bottleneck portion of the bottle blank is fed into the crystallizer, the temperature of the bottle blank is controlled in a range of 130–170° C. by a bottleneck temperature controller.

5. A method according to claim 1, wherein the crystallization time required for each bottle blank is controlled in a range of 90–120 sec.

6. A method according to claim 2, wherein the crystallization time required for each blank is controlled in a range of 90–120 sec.

7. A method according to claim 3, wherein the crystallization time required for each blank is controlled in a range of 90–120 sec.

8. A method according to claim 4, wherein the crystallization time required for each blank is controlled in a range of 90–120 sec.

9. A method for manufacturing a crystallized bottleneck of a polyester beer bottle, comprising the steps of:

forming a blank of a bottle made of polyester material through drying;

ejecting the polyester material and shaping said ejected polyester material through cooling, thereby forming an uncrystallized blank of a bottle;

placing the uncrystallized blank of the bottle for 24–72 hours in an air-conditioned environment;

preheating a crystallizer for at least two hours prior to crystallizing the blank of the bottle;

loading a bunker with the uncrystallized blank of the bottle;

delivering to an blank horse's head via a conveyor belt;

sending a bottleneck portion of the uncrystallized bottle blank into said crystallizer to heat the bottleneck portion at a high temperature and crystallize the bottleneck portion via an arbor transmission chain;

at the same time, while the bottle is crystallized in the crystallizer, the body portion of the bottle blank is protected from the high temperature environment of the crystallizer by using a cooling partition, controlling the temperature of the uncrystallized portion of the blank body, so that the uncrystallized portion of the blank body is not affected by the high temperature environment of the crystallizer;

discharging the polyester bottle blank through an output blank horse's head; and delivering to another conveyor belt to cool and shape the polyester bottle blank.

* * * * *